US005842366A

United States Patent [19]

Klingel et al.

[11] Patent Number: 5,842,366

[45] Date of Patent: Dec. 1, 1998

[54] METHOD AND A TOOLING MACHINE FOR BENDING WORKPIECES

[75] Inventors: Hans Klingel, Moeglingen; Armin Horn, Renningen, both of Germany

[73] Assignee: Trumpf GmbH & Company, Ditzingen, Germany

[21] Appl. No.: 776,862

[22] PCT Filed: Jun. 11, 1996

[86] PCT No.: PCT/EP96/02531

§ 371 Date: Feb. 7, 1997

§ 102(e) Date: Feb. 7, 1997

[87] PCT Pub. No.: WO96/41690

PCT Pub. Date: Dec. 27, 1996

[30] Foreign Application Priority Data

Jun. 12, 1995 [DE] Germany ..... 195 21 369.6

[51] Int. Cl.[6] ..... B21D 5/02

[52] U.S. Cl. ..... 72/31.1; 72/31.11; 72/389.3; 72/702

[58] Field of Search ..... 72/31.1, 31.11, 72/702, 389.3, 389.5

[56] References Cited

U.S. PATENT DOCUMENTS

| | | | |
|---|---|---|---|
| 4,489,586 | 12/1984 | Hess | 72/31.11 |
| 4,864,509 | 9/1989 | Somerville et al. | 72/702 |
| 5,007,264 | 4/1991 | Haack | 72/702 |
| 5,062,283 | 11/1991 | Miyagawa et al. | 72/31.1 |
| 5,483,750 | 1/1996 | Ooenoki et al. | 72/389.3 |
| 5,603,236 | 2/1997 | Hongo | 72/31.11 |

FOREIGN PATENT DOCUMENTS

| | | | |
|---|---|---|---|
| 166351 | 1/1986 | European Pat. Off. | 72/702 |
| 2362722 | 3/1978 | France | 72/389.3 |
| 57-202928 | 12/1982 | Japan | 72/389.3 |
| 59-82119 | 5/1984 | Japan | 72/31.1 |
| 59-174221 | 10/1984 | Japan | 72/31.1 |
| 3-184629 | 8/1991 | Japan | 72/31.1 |

*Primary Examiner*—David Jones
*Attorney, Agent, or Firm*—Pepe & Hazard LLP

[57] ABSTRACT

As part of a process for bending workpieces (14), when the workpiece (14) is released from the upper die (8) and/or the lower die (10), the actual size of the bending angle (β) is continually determined; from the actual size of the bending angle (β) found, the change in it is determined and, as soon as the change in the actual size of the bending angle (β) assumes a predetermined value, the actual size of the then existing bending angle (β) is compared with the desired size.

On a tooling machine for carrying out the method described, there are scanning elements (17,18) and a device (24) for determining the actual size of the bending angle (β) that are parts of a device (19) for determining the change in the actual size of the bending angle (β). The device (24) for determining the actual size of the bending angle (β) is connected to a comparison device (32) for comparing the actual size of the bending angle (β) to the desired size.

14 Claims, 10 Drawing Sheets

METHOD AND A TOOLING MACHINE FOR BENDING WORKPIECES

BACKGROUND OF THE INVENTION

The invention concerns a method of bending workpieces, especially sheet metal, in which there is a workpiece acted on by a upper die and/or a lower die that works with it, and at least one side of the workpiece is bent at an angle in relation to at least one other side of the workpiece, and the workpiece is then released from the upper die and/or the lower die, and, when the workpiece is released from the upper die and/or the lower die, the actual size of the bending angle is determined and after at least approximately complete release of the workpiece from the upper die and/or the lower die, the actual size of the bending angle then existing is compared to the desired size.

The invention also concerns a tooling machine for bending workpieces, especially sheet metal, by a method like the one described, with a lower die and a upper die that works with it and is able to move in the bending direction relative to it with a drive regulated by controls, as well as at least two scanning elements, which can be moved in relation to one another in the bending direction relative to the upper die and/or lower die and are supported in the measurement position on at least one of two sides of the bent workpiece that form a bending angle on the bent workpiece, wherein the relative position of the scanning elements is a measure of the actual size of the bending angle, and the scanning elements are connected to a device for determining the actual size of the bending angle.

As is known, when workpieces are bent, especially sheet metal, an unwanted elastic deformation of the workpiece occurs, in addition to the plastic deformation sought. Due to the elastic deformation, after the workpiece in question is released from the upper die, the result is a springing of the workpiece angle made during the bending process and with it an increase in the bending angle formed by the sides of the workpiece angle. This makes it harder to bend workpieces with a definite bending angle whose actual size is predetermined.

In one common conventional method, the phenomenon described is taken into account by the fact that, after the first work cycle, when the workpiece is released, the actual size of the bending angle achieved is measured and compared to its desired size. If it turns out from this comparison that the actual angle is larger than the desired angle, a corrective work cycle is started, after the end of which when the workpiece is released, another actual/desired size comparison is made of the bending angle. The bent workpiece is rebent and corrected until the desired tooling result is achieved.

To use the method described, a bending machine or press brake with the conventional features specified at the beginning is used. Here, the distance between the scanning elements in the bending direction and in the direction of movement is used as the basis for trigonometric calculation of the bending angle.

Other known tooling machines for using the conventional method employ an inductive or a pneumatic measurement device. In both cases, when the workpiece is released from the upper die after a bending process for two points on each side of the workpiece, its distance from the opposite side and a side on the lower die bounded in cross section by a V-shaped groove is determined. The course of the sides of the groove of the lower die gives the desired size of the bending angle to be made. By determining the distance between the measuring points on the sides of the workpieces from the assigned groove side, it is determined whether the workpiece sides run parallel to the groove sides and thus form the angle that is desired, or whether the sides of the workpiece angle are in turn pointing at an angle to the sides of the groove and as a result deviate from their desired course. The actual size of the bending angle made in the preceding bending cycle is determined from the distance values measured.

With the state of the art described above, there are neither method-related nor device-related means that would make it possible to measure the actual size of the bending angle defined directly when the bent workpiece is in the state where it is released from the upper die or in a quasi-load-free state that comes very close to the released state. This type of optimization of the timing for determining the actual size of the bending angle made in the preceding work cycle has great significance, for example, in terms of the tooling speed that can be achieved and/or in terms of the safety of the method. If the actual size of the bending angle on a bent workpiece is determined at the earliest possible time, i.e., at the time when the bent workpiece is first load-free or almost load-free, a corrective bending cycle can also be introduced at the earliest possible time. Total tooling periods that take an unnecessarily long time, in which to wait to determine the actual size of the bending angle, although the bent workpiece is already load-free or quasi load-free, can thereby be avoided.

Measuring the actual size of the bending angle directly when the load-free state is reached by the bent workpiece after the forming process is made possible in the case of another known conventional method by the fact that the course of the force effective during the release stroke of the upper die between the upper die and the bent workpiece over the amount of the release stroke is determined approximately. From the then approximately known course of the force effective between the upper die and the bent workpiece during the release stroke, the amount of the release stroke is determined in which the force effective between the upper die and the bent workpiece first assumes the value zero and in which accordingly the bent workpiece reaches the state where it is released from the upper die. In addition, in the previously known method, based on individual measurements, the approximate course of the actual size of the bending angle over the amount of the release stroke of the upper die is determined. Using this course of the actual size of the bending angle over the amount of the release stroke, the actual size of the bending angle is determined and is assigned to the predetermined amount of the release stroke, in which the force effective between the upper die and the bent workpiece reaches the value zero. The actual value of the bending angle so obtained on the load-free workpiece is compared to the desired size of the bending angle, and the result in the case of deviation in the angle is used as the basis for a subsequent corrective tooling cycle.

SUMMARY OF THE INVENTION

Starting from the state of the art just mentioned, this invention is based on the task of providing a method that makes it simpler to determine the deviation in the actual size of the bending angle on a load-free or quasi load-free bent workpiece from the desired size of the bending angle at the earliest possible point in time or a point in time that comes very close to the earliest possible point in time. In terms of a device, this invention aims to create a bending machine by means of which the method in the invention can be used.

The invention solves the method-related task with a method like the one described at the-beginning, in which the actual size of the bending angle is continuously determined as the workpiece is released from the upper die and/or lower die, by determining the actual size of the bending angle and finding the change in it; and as soon as the change found in the actual size of the bending angle assumes a predetermined value, the actual size of the bending angle then existing is compared to the desired size. In this way, the value zero or a value very close to it can be predetermined as the value for the change in the actual size of the bending angle reached when the actual/desired sizes are compared. For the sake of simplicity, the method in the invention uses the development of the size, namely the actual size of the bending angle at whose exact dimension the bending process is directed with a predetermined desired size, as the parameter for the tension and load state of the bent workpiece. This simultaneously gives the method in the invention high precision.

For this purpose, in the case of one version of the method in the invention, in which the upper die and the lower die are moved in relation to one another when the workpiece is released, during the release of the workpiece, the course of the actual size of the bending angle is taken as a correlation of the amount of movement or the time of relative movement of the upper die and the lower die, and from that course, the change in the actual size of the bending angle per unit of amount of or time of relative movement of the upper die and lower die is determined. In this case, the figure shows the gradient in the tangents on the graphs of the actual size of the bending angle over the amount or time of relative movement of the upper die and the lower die found as parameters to measure the change in the actual size of the bending angle when the workpiece is released. If the gradient assumes the value zero, this means that the actual size of the bending angle no longer changes with continued relative movement of the upper die and lower die, and that accordingly the bent workpiece has reached its load-free state and the actual/desired size comparison can be made for the bending angle. In terms of the method in the invention, if a value close to zero is taken as the value for the change in the actual size of the bending angle at which the actual/desired size comparison is to be made, this is identical to the specification of a gradient of the tangents approximating zero on the graphs of the actual value of the bending angle over the amount of movement or time of relative movement of the upper die and the lower die.

Another version of the method in the invention, in which the upper die and the lower die are moved in relation to one another when the workpiece is released, provides that the relative movement of the upper die and the lower die end as soon as the change in the actual size of the bending angle when the workpiece is released assumes the predetermined value. In terms of increasing process safety, this measure makes sure that the bent workpiece is also held in the state released from the upper die or in its quasi load-free state between the upper die and the lower die. With the value predetermined for the change in the actual value of the bending angle, at which the actual/desired size comparison is made, if the value is close to zero, this is the same as if between the bent workpiece and the upper die, another minimum force is effective, which fixes the position of the bent workpiece between the upper die and the lower die, but does not have any noteworthy influence on the size of the bending angle. If the value zero is given as the value that defines the point in time of the actual/desired size comparison, then the bent workpiece is fully released from the upper die at the decisive time. Since determining the fully load-free state of the bent workpiece hastens the onset of this state minimally in time and accordingly the relative movement of the upper die and the lower die ends only a minimum period of time after complete release of the bent workpiece, in this case there is some slight play between the bent workpiece and the upper die and the lower die, but it does not necessarily influence the fixing of the position of the bent workpiece. In both cases, it is basically guaranteed that the bent workpiece does not change the position it took at the end of the bending action and kept during its release from the upper die and the lower die, as soon as it reached its load-free or quasi-load-free state. This fact is significant, particularly in view of the fact that the deviation found when the actual size of the bending angle in the released or quasi-load-free bent workpiece is compared with the desired size of the bending angle, if necessary, serves as a corrective value for retooling the bent workpiece, and during retooling the alignment of the workpiece to the upper die must be identical to the alignment during the preceding work cycle, so that the desired tooling results can be achieved. After an initial bending cycle, if the actual/desired size comparison shows that the actual size of the bending angle made in the released or quasi-load-free bent workpiece is over the sought-after desired size by a certain amount, then based on the deviation found, the penetration depth of the upper die on the lower die specified for a subsequent correcting bending cycle exceeds the penetration depth during the preceding work cycle by the amount determined, depending on how much the actual size of the bending angle deviates from the desired size.

The above-mentioned device-related task is solved by the invention with a tooling machine of the type specified at the beginning, in the case of which the scanning elements and the device for determining the actual size of the bending angle are parts of a device for determining the change in the actual size of the bending angle, and the device for determining the actual size of the bending angle is connected to a comparison device for comparing the actual size of the bending angle with a desired size. Based on the relative movement of the upper die and the scanning elements, the upper die and the lower die can be moved away from them after the workpiece is bent, while the scanning elements approach the surface of the workpiece or at least one side of the workpiece angle made. The springing of the side of the workpiece connected with the release of the bent workpiece and the associated change in the actual size of the bending angle causes a displacement of the scanning elements lying on the bent workpiece relative to one another in the bending direction. A change in the relative position of the scanning elements in the direction specified indicates accordingly a change in the actual size of the bending angle on the bent workpiece. As soon as the scanning elements no longer change their mutual position in the bending direction, the bent workpiece has reached the state where it is released from the upper die and where the actual size of the bending angle corresponds to the actual size of the bending angle made by the preceding bending cycle. If the amount of the change in the relative position of the scanning elements in the bending direction is not equal, but very close, to zero, this shows that the actual size of the bending angle changes only minimally and accordingly has reached a value that is very close to the value given to the fully released state of the bent workpiece.

In both cases, the actual sizes of the bending angle can be calculated from the relative positions of the scanning elements using the device provided for determining it. Starting from the actual size of the bending angle calculated, the change can be determined with the device provided for this. If the value zero or a value very close to it is the result of the change in the actual size of the bending angle, then the comparison device is activated, and the actual size of the bending angle when it reaches the change value of zero or a value very close to that change value is compared to a certain desired size of the bending angle to be made. The scanning elements thus supply the baseline data, on the basis of which it is determined whether the actual size of the bending angle changes when the workpiece is released, or whether that state of the bent workpiece is reached in which the actual/desired size comparison for the bending angle should be made. The scanning elements are thus a mechanical part of the device in the invention for determining the change in the actual size of the bending angle.

Another component of this device for determining the optimal time of the actual-desired size comparison for the bending angle is the device for determining the actual size of the bending angle. With it, sizes are determined which when compared in a comparison unit for the actual sizes of the bending angle can directly determine whether or not there is a change in the actual size of the bending angle.

One convenient version of the tooling machine in the invention provides that the device for determining the actual size of the bending angle in the bending direction has slides on the upper die, one of which can be moved in the bending direction with one of the scanning elements. The embodiment of the machines in the invention described makes it possible to place the device for determining the actual size of the bending angle at a sufficient distance from the workpiece being tooled, and in an area in which sufficient installation space is available. The position of the scanning elements to one another in this version of the invention is indicated by the relative position of the slides connected to the scanning elements.

A highly precise determination of the relative position of the scanning elements and thus the provision of extremely precise baseline data for determining the value of any changes in the actual size of the bending angle in the case of one preferred form of embodiment of the tooling machine in the invention is made possible by the fact that the device for determining the actual size of the bending angle has a light source that is connected to one of the scanning elements and can be moved with it in the bending direction, preferably a corresponding LED, as well as at least one optical sensor that is connected to the other scanning element, can move with it in the bending direction and is assigned to the light source, preferably a PSD (Position Sensitive Detector). What is more, the components described in the device in the invention for determining the actual size of the bending angle need very little space. This makes it possible to build the whole device into the upper die.

So that the device for determining the change in the actual size of the bending angle can supply sufficiently precise results, the actual sizes of the bending angles, from a comparison of which the changes that occur are calculated, if necessary, must be determined precisely. This in turn presupposes that the relative positions of the scanning elements from which the actual size of the bending angle to be compared are found reflects as precisely as possible the course of the side of the bending angle on the bent workpiece. For this reason, the support of the scanning elements on the side or sides in question of the bent workpiece must be carefully defined. The invention takes this requirement into account by having the scanning elements in the measurement position project crosswise to the plane of the upper die defined by one edge of the upper die and the bending direction and lie on both sides of the bent workpiece, wherein the scanning elements are supported on one and the same side of the plane specified, at different distances from the forming edge on the sides of the bent workpiece.

Scanning elements that can be used as components of the devices in the invention for determining the change in the actual size of the bending angle can be designed in various ways. Thus, in the sense of the invention, scanning elements designed as disks or disk segments are provided, as are scanning elements in the form of scanning rods aligned crosswise to the plane defined by one forming edge of the upper die and the bending direction. Scanning elements designed especially as disks or disk segments can be produced at low manufacturing expense. They are correspondingly thin, so they can lie on the bent workpiece with point-like contact in the measurement position and can run into recesses in the form of narrow slits on the upper die in the bending direction.

One preferred form of embodiment of the tooling machine in the invention is characterized by the fact that the scanning elements can be deflected in relation to one another crosswise to the plane defined by one forming edge of the upper die and the bending direction. Based on the relative movement of the scanning elements that was described crosswise to the plane mentioned, the scanning elements can be placed next to the bent workpiece when the two sides of it have different courses. If necessary, the scanning elements are capable of being positioned automatically relative to one another in the crosswise direction of said plane in such a way that both scanning elements are adjacent to the side or sides of the bent workpiece in question.

The relative transverse movement of the scanning elements in the crosswise direction of the plane defined by the forming edge of the upper die and the bending direction is brought about, according to the invention, for one thing, by the fact that the scanning elements can be swiveled in relation to one another crosswise to said plane. In addition or alternately, the relative transverse movement of the scanning elements in the invention can be brought about by the fact that the scanning elements can be moved in relation to one another crosswise to said plane.

When a relative movement is being executed in the crosswise direction of the plane defined by a forming edge of the upper die and the bending direction, if the scanning elements are adjacent to the workpiece side(s), the results of determining the actual size of the bending angle can be influenced thereby. In any case, the influence of the relative crosswise deflection of the scanning elements described on the actual size of the resultant bending angle is extremely small.

However, if the actual size of the bending angle needs to be determined with high precision, this influence must still be considered. For this purpose, in the case of one preferred embodiment of the tooling machine in the invention, in which the scanning elements can be deflected relative to one another crosswise to the plane defined by one forming edge of the upper die and the bending direction, as part of the device for determining the change in the actual size of the bending angle, a device for determining the relative transverse deflection of the scanning elements is provided, by means of which the relative transverse deflection of the scanning elements is considered in determining the actual size of the bending angle.

An extremely precise determination of the relative transverse deflection of the scanning elements is made in the case of another version of the tooling machine in the invention with scanning elements that can be deflected in relation to one another crosswise to the plane defined by one forming edge of the upper die and the bending direction in such a way that the device for determining the relative crosswise deflection of the scanning elements has at least one light source connected to one of the scanning elements and to that light source, which can be deflected crosswise and is preferably a corresponding LED, as well as an optical sensor connected to the other scanning element, which can be deflected crosswise to it and is assigned to the light source, preferably a corresponding PSD.

In terms of a structural simplification of the tooling machines in the invention, in the case of which the device for determining the actual size of the bending angle has at least one light source that can be moved with one of the scanning elements in the bending direction and at least one optical sensor that can be moved in the same direction with the other scanning element, the light source(s) that can move with the scanning elements in the bending direction or the corresponding optical sensor(s) is (are) provided as the light source and as an optical sensor for determining the relative transverse deflection of the scanning elements.

Largely automated workpiece tooling permits a form of embodiment of the bending machine in the invention, in the case of which the device for determining the change in the actual size of the bending angle is connected to the drive-control device. If the device for determining the change in the actual size of the bending angle finds that the change caused by an elastic return movement of the side of the bent workpiece in the actual size of the bending angle has reached the predetermined value, i.e., the value 0 or a value very close to it, then the relative movement of the upper die and lower die used to release the bent workpiece is ended by the drive-control device. This ensures that the upper die and the lower die do not move in relation to one another, as soon as the bent workpiece reaches its load-free or quasi load-free state. In their position, the upper die and the lower die fix the bent workpiece in the tooling position. In addition, the actual size of the bending angle that is assigned to the load-free or quasi load-free state of the bent workpiece is determined. This actual size of the bending angle is compared with the predetermined desired size, and the existing deviation is used, if necessary, as the basis for a corrective retooling cycle that starts and is carried out automatically.

Generally, it should be pointed out that the method in the invention and the device in the invention are basically suitable both for tooling a workpiece after the stamping process and for tooling a workpiece by so-called "air bending."

BRIEF DESCRIPTION OF THE DRAWINGS

The invention will be described in greater detail below using schematic drawings of examples of embodiment.

DETAILED DESCRIPTION OF THE PREFERRED EMBODIMENT

Figure 1:
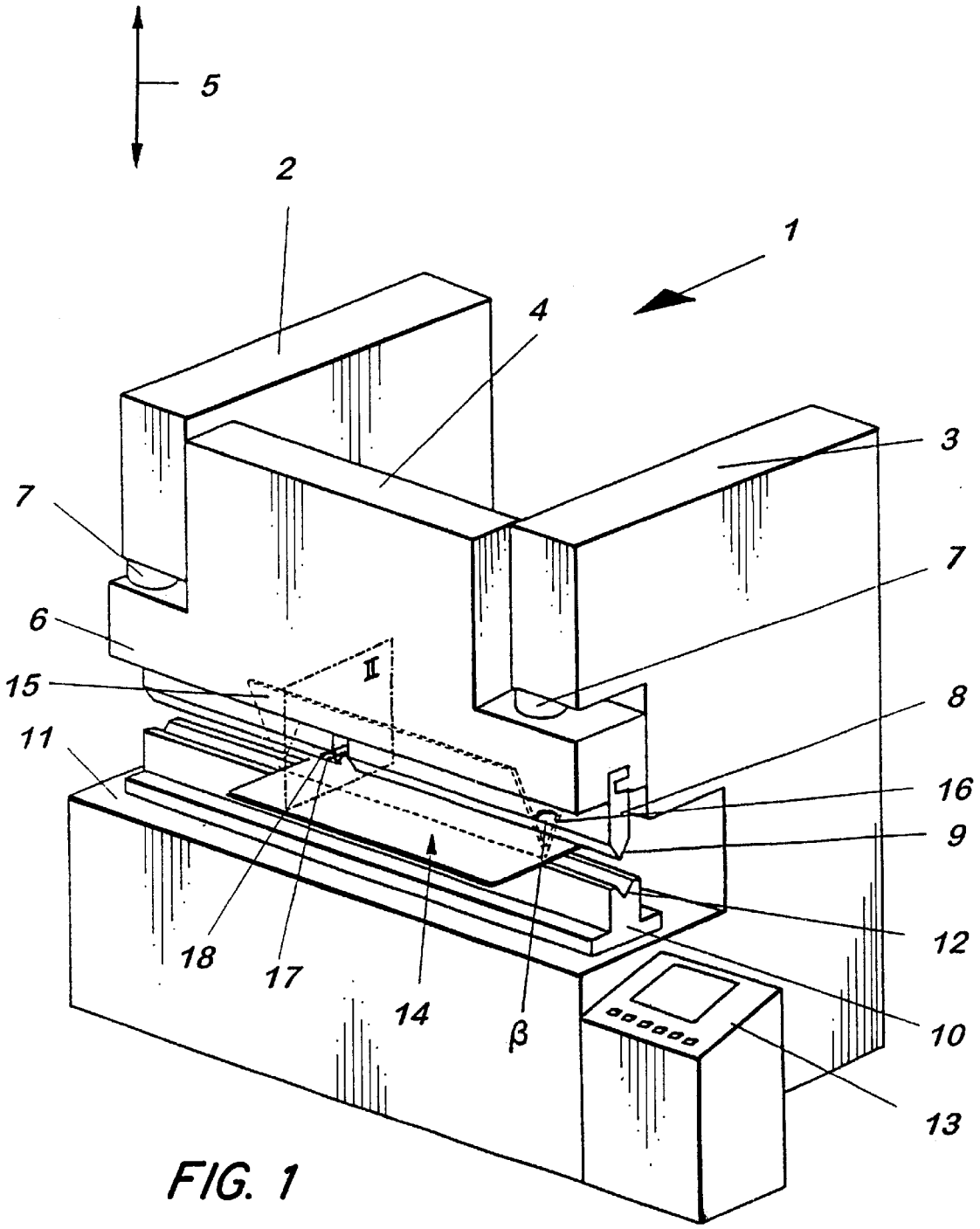
FIG. 1 is a perspective overall view of a first embodiment of a hydraulic bending press with a device for determining the change in the actual size of the bending angle.

A bending press 1 shown in FIG. 1 includes a machine frame with two legs 2, 3. A top clamping bar 4 runs between the legs 2, 3, so that it can be raised and lowered in the vertical bending direction shown by double arrow 5. On its lower end, the top clamping bar 4 moves into a press beam 6, which extends over the whole front of the machine. Hydraulic press cylinders 7 that act on the press beam 6 are used to raise and lower the top clamping bar 4. A back-cut longitudinal groove in the press beam 6 holds an elongated top bending die 8, which has on the bottom a forming edge 9. The upper die 8 acts along with an elongated bottom die 10. The latter is mounted on a table 11 of the bending press 1 and has a V-shaped groove 12 on the upper side of it facing the upper die 8.

The drive controls for the bending press 1 and other devices for automatic machine operation are placed on a control panel 13, and during operation a workpiece 14, namely a piece of sheet metal, is bent. In its initial position, the sheet metal 14 is shown in FIG. 1 in solid lines. In its bent state, in which there are two sides 15, 16 to the workpiece that form a bending angle β, the sheet metal 14 is shown in broken lines. FIG. 1 also indicates the scanning elements 17, 18 of the device 19 for determining the change in the actual size of the bending angle β.

Figure 2A:
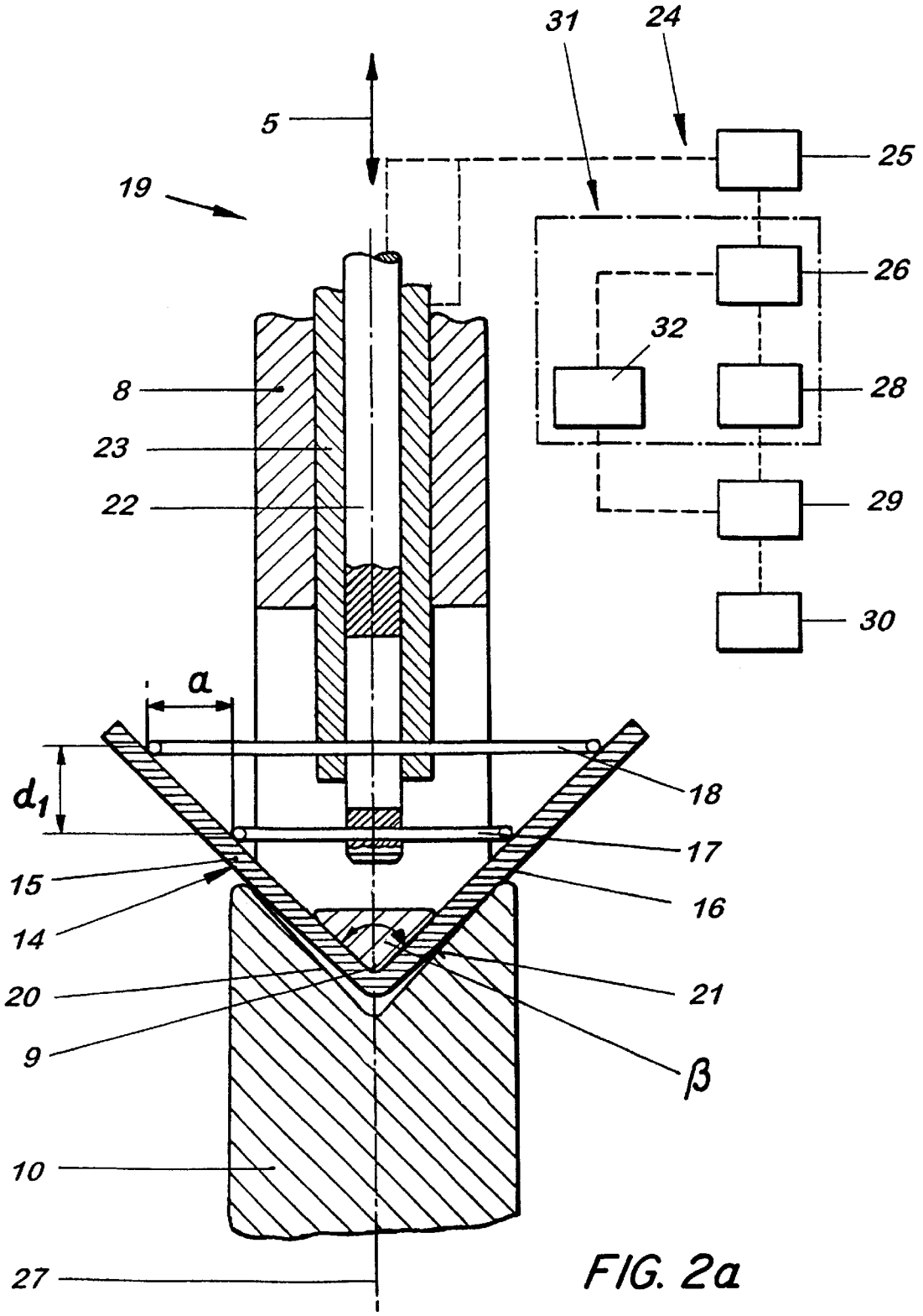
FIG. 2*a* is a fragmentary sectional view looking downwardly in the plane designated II of FIG. 1 with the upper die moved to the lower end position.

FIG. 2*a* shows the ratios at the point in the bending process where the upper die 8 is in a position where the sides of the sheet metal 15, 16 form a bending angle β, and the actual size corresponds to the desired size, in this case 90°. The scanning elements 17, 18 are held on slides 22, 23, which are arranged concentrically to one another and can be moved inside the upper die 8 running in the bending direction 5 relative to one another and relative to the upper die 8. In their position in FIG. 2*a*, the scanning elements 17, 18 are arranged at a mutual distance $d_1$ in the bending direction 5. Crosswise to the bending direction 5, the contact points of the scanning element 17, 18 have a predetermined, known distance a on the sides 15, 16 of the sheet metal. The slides 22, 23 are part of a device 24 for determining the actual size of the bending angle β.

Figure 2B:
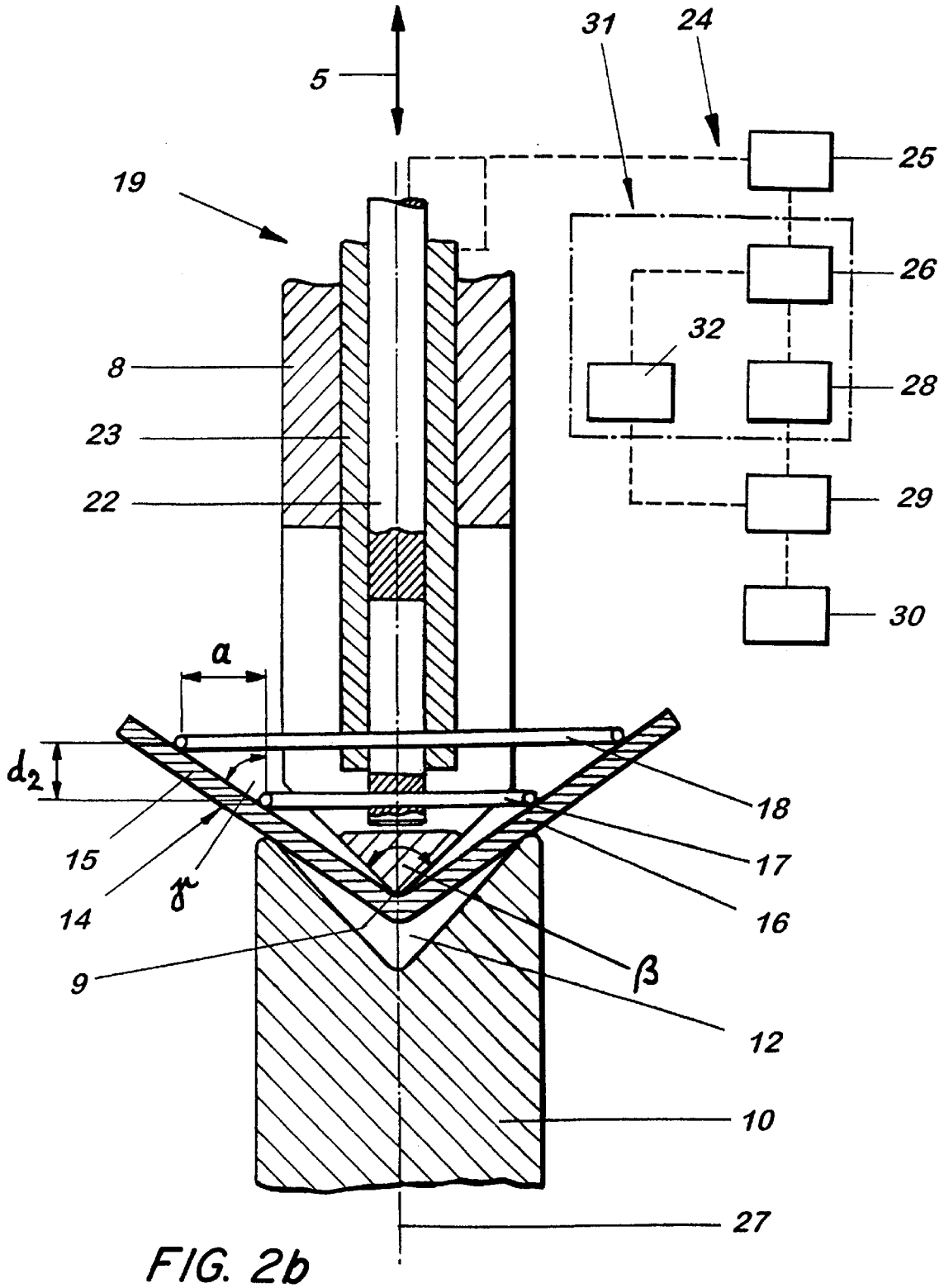
FIG. 2*b* is a fragmentary view similar FIG. 2*a* with the workpiece released from the upper die after bending.

Now, if the upper die 8 is moved away from the sheet metal 14 from its position shown in FIG. 2*a* along the bending direction 5, effective elastic return forces in the sheet metal 14 cause a springing of the bent sheet metal 14 from the state shown in FIG. 2*a* into the state in FIG. 2*b*. In this way, the actual size of the bending angle β formed by the sides 15, 16 of the sheet metal increases. A change in the relative position of the scanning elements 17, 18 in the bending direction is connected with the springing of the bent sheet metal 14. While the scanning elements 17, 18 in the tooling state in FIG. 2*a* have a distance $d_1$ in bending direction 5, they assume an opposite distance $d_2$ n that direction in FIG. 2*b*. When the sheet metal 14 is released from the state shown in FIG. 2*a* up to the state in FIG. 2*b*, the relative position of the scanning elements 17, 18 in the bending direction 5 has changed by $(d_1-d_2)$. The horizontal distance a of the contact points between the sides of the sheet metal 15, 16 and the scanning elements 17, 18 remains unchanged.

During the release of the sheet metal 14 from the upper die 8 that was described, the actual size of the bending angle β is continually determined by means of the device 24 shown only in outline form in FIGS. 2*a* and 2*b*. The device 24 for determining the actual size of the bending angle β includes, for that purpose, besides the slides 22, 23, a device 25 for determining the relative position of the slides 22, 23 in the bending direction 5. Based on the connection between the slides 22, 23 and the scanning elements 17, 18, the relative position of the scanning elements 17, 18 in said direction is determined by means of the device 25 with the relative position of the slides 22, 23 in the bending direction 5. In the tooling phase in FIG. 2*b*, this relative position is represented roughly by the distance $d_2$. From the distance found d2 and the unchanged distance a, crosswise to the bending direction 5, the actual size of an angle α is calculated by a computer 26 in the device 24 for determining the actual size of the bending angle β using a trigonometric function.

Since in the case of the application sketched in FIGS. 2*a* and 2*b*, the ratios in terms of an axis of movement 27, shown in dots and dashes, of the scanning elements 17, 18 in the bending direction are symmetrical, the actual size of the angle α determined corresponds to half the actual size of the bending angle β. Based on the symmetrical course of the workpiece sides 15, 16 in relation to the movement axis 27, to calculate the actual size of the bending angle β as described above requires only one contact point of the scanning elements 17, 18 with the workpiece 14, wherein both contact points, for this purpose, lie on one and the same side of the forming edge 9 of the bending die 8 at different distances from the forming edge 9.

By means of a comparison unit 28, the actual sizes of the bending angle β set as the sheet metal 14 is being released from the upper die 8 and determined continuously by the computer between the sides 15, 16 of the workpiece are compared with one another. The difference between the actual size of the bending angle β and the actual size previously calculated is determined.

If the upper die 8 starts from its position shown in FIG. 2*b* and moves away from the bent sheet metal 14 in the bending direction 5, the sides 15, 16 of the workpiece open up more, i.e., the actual size of the bending angle enclosed by the sides 15, 16 of the workpiece assumes a value that lies over the value of the actual size of the bending angle β in FIG. 2*b*. The splaying of the sides of the workpiece 15, 16 and the associated increase in the actual size of the bending angle β formed by it ends as soon as the sheet metal 14 is released from the upper die 8. When this released state occurs, another return-stroke movement of the upper die 8 no longer causes an increase in the actual size of the bending angle β enclosed by the sides 15, 16 of the workpiece. The deviation determined by the comparison unit 28 in the actual size of the bending angle β from the actual size calculated before directly from this actual size assumes the value 0 from that point on.

A deviation 0 in two actual sizes of the bending angle β calculated one after the other thus indicates the load-free state of the sheet metal 14 has occurred, and hence the presence of the actual size of the bending angle β made with the bending method in question.

If there is a change in the relative position of the scanning elements 17, 18 in the bending direction 5 and thus no more change in the actual size of the bending angle β occurs, then a signal is given by the comparison unit 28 to the drive controls 29, on the basis of which the latter stops the machine drive 30 of the bending press 1. As a result, the upper die 8 opposite the lower die 10 in the bending direction 5 freezes roughly in the position it reached when the value zero was first calculated for the difference in two actual sizes of the bending angle β one after another by the comparison unit 28. In this state, in which the sheet metal 14 has reached its load-free state, the upper die 8 and the lower die 10 are arranged right next to the sheet metal 14. As a result, the sheet metal 14 is fixed in its instantaneous position by the upper die 8 and the lower die 10 that works with it.

Alternately to the routine described above, the signal to stop the machine drive 30 can also be given to the drive controls 29—as soon as the deviation calculated by the comparison unit 28 between two actual sizes of the bending angle β one after the other assumes not the value 0, but a value close to 0. In this case, the sheet metal 14 has reached a quasi load-free state when the machine drive 30 is stopped.

The computer 26 described above for calculating the actual sizes of the bending angle β and the comparison unit 28 connected to its output side to compare actual sizes of the bending angle β calculated one after the other are components of a central computer 31. With its help, using computer 26, the actual size of the bending angle β is determined, which is assigned to achievement of the load-free or the quasi-load-free state of the sheet metal 14. This real actual size of the bending angle β made in the bending process is then compared to the desired size of the bending angle β, hence with the size with which the bending angle β should be produced. For this purpose, there is a comparison device 32 for comparing an actual size of the bending angle β with a desired size, wherein the comparison unit 32 is also part of the central computer 31.

The deviation found during the actual-desired comparison in the actual size of the bending angle β made from the desired size is used by the central computer 31 to specify the tooling parameters for a subsequent corrective bending cycle to the machine drive 30 via the drive controls 29. The central computer 31 has access to recorded values, for example, for characterizing the material and/or the thickness of the sheet metal 14. If a certain value is found for the difference between the actual size of the bending angle β in the released or quasi load-free sheet metal 14 and the desired size of the bending angle β, the central computer 31 takes into account the thickness and/or material the sheet metal 14 is made of and based on the deviation, calculates the necessary penetration depth of the upper die 8 into the matrix 10, over which the upper die 8 must travel into the lower die 10 during the subsequent corrective tooling cycle, so that as a result of the corrective bending process, a bending angle β with the desired size is produced. As a first approximation, for the corrective bending process, a die penetration depth can be preset in which the sheet metal 14 in the lower end position of the upper die 8 has a bending angle β with an actual size that is smaller than the preset desired size by the deviation previously found in the angle.

Figure 3:
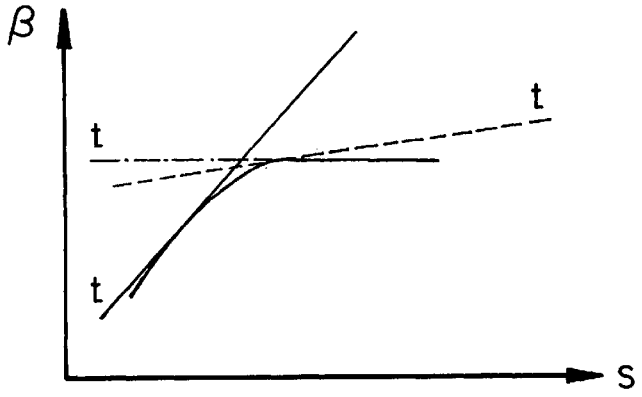
FIG. 3 is a graph of the actual size of the bending angle as a function of the return stroke s of the upper die during the bending of the workpiece in FIGS. 1 to 2*b,*

The criteria by which the signal in the central computer 31 is activated to the drive controls 29 to stop the machine drive 30 can be seen in FIG. 3.

Thus, in the central computer 31, the course of the actual size of the bending angle β is determined over the path s, which the upper die 8 travels when the sheet metal 14 is released. Then, by means of the central computer 31 for each actual size of the bending angle β, the pitch of the tangents t on the graphs of the bending angle β is determined over the amount s. If the pitch of the tangent t takes the value 0 or a value very close to 0 and the tangent t accordingly runs horizontally or approximately horizontally, as in FIG. 3, this shows that the deviation calculated by means of the comparison unit 28 between two actual sizes of the bending angle β found one after the other is equal to 0 or comes very close to the value 0. This in turn is the same as the onset of the load-free or quasi load-free state of the sheet metal 14 and thus marks the point or that part of the return stroke movement of the upper die 8, where the machine drive 30 is stopped by the central computer 31 via the drive controls 29 and then a corrective bending cycle is introduced, if necessary.

Figure 4:
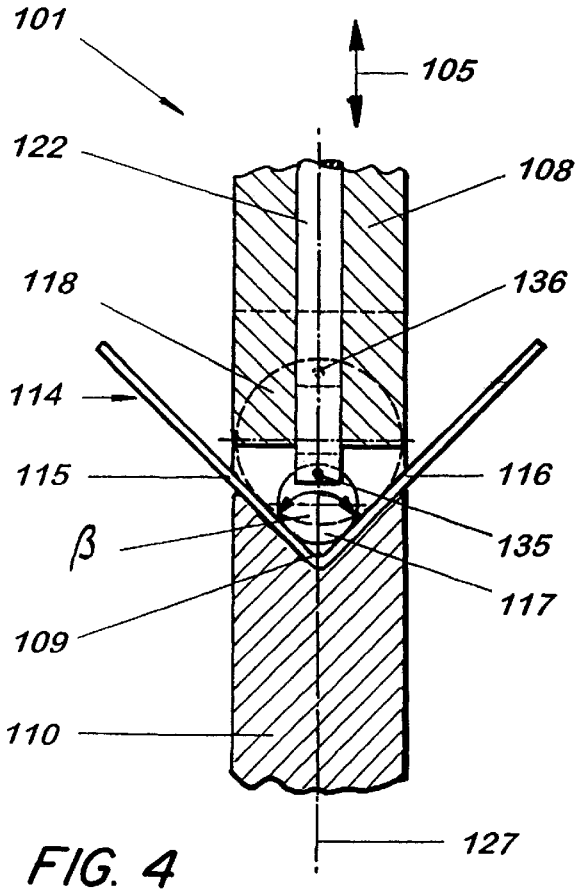
FIG. 4 is a fragmentary sectional view of the bending press with a second embodiment of measuring devices shown partially in phantom line.
Figure 5:
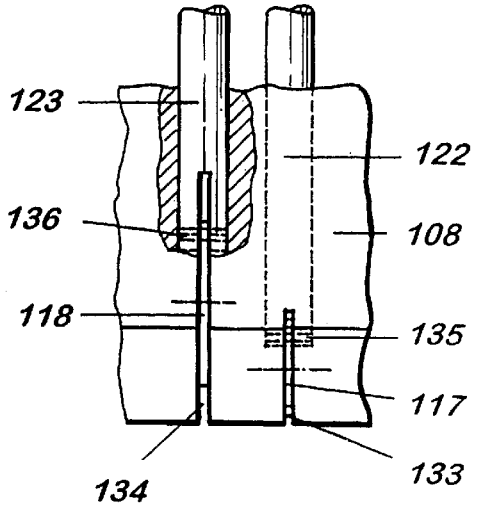
FIG. 5 is a fragmentary sectional side view in the area of the upper die of the bending press in FIG. 4 showing the measuring devices.

In the case of a bending press 101 as shown in FIGS. 4 and 5, a piece of sheet metal 114 is bent by the working of a upper die 108 and a lower die 110, with the formation of two workpiece sides 115, 116 enclosing a bending angle β. Like the scanning elements 17, 18 of the bending press 1 in FIGS. 1 to 3, scanning elements 117, 118 of the bending press 101 are also built into the upper die 108. Unlike the scanning elements 17, 18 of the sinking bending press 1, the scanning elements 117, 118 of the sinking bending press 101 are designed as scanning disks, not as scanning rods. The scanning elements 117, 118 fit into guide slides 133, 134 on the upper die 108 and can be moved relative to it and relative to one another. To guide the scanning elements 117, 118 in the bending direction 105, slides 122, 123 are used to which the scanning elements 117, 118 are jointed by means of pivoting axes 135, 136. Because of their pivoting movement, the scanning elements 117, 118 can be deflected relative to one another crosswise to the plane defined by one edge 109 of the upper die 108 and the bending direction 105. The deflection of the scanning elements 117, 118 described makes it possible for them to be centered automatically in cases where an axis 127 of movement of the scanning elements 117, 118 in the bending direction 105, unlike in the example shown, does not coincide with the median of the bending angle B between the sides 115, 116 of the workpiece.

Besides the guidance function already described above, the slides 122, 123 have the task of keeping the scanning elements 117, 118 from falling out of the guide slots 133, 134 that open into the forming edge 109 of the die 108.

Bent slots 133, 134 on the upper die 108 has special significance. It allows the feature specified of using the scanning elements 117, 118 right up to the forming edge 109 of the upper die 108. Accordingly, the scanning elements 117, 118 can also be put in position on the sides of the workpiece, which extend from the forming edge 109 only over a short length of the edge. The scanning elements in FIGS. 4 and 5 thus make it possible to determine the actual size of the bending angle β and the change in the actual size of the bending angle β in cases where workpieces with very short sides are bent.

Since the scanning elements 117, 118 are designed as small thin plates and the guide slots 133, 134 must not be very wide in the direction of the forming edge 109, only a very short length of the forming edge 109 near the guide slots 133, 134 is interrupted, and the quality of the tooling results that can be achieved with the upper die is not affected.

Figure 6A:
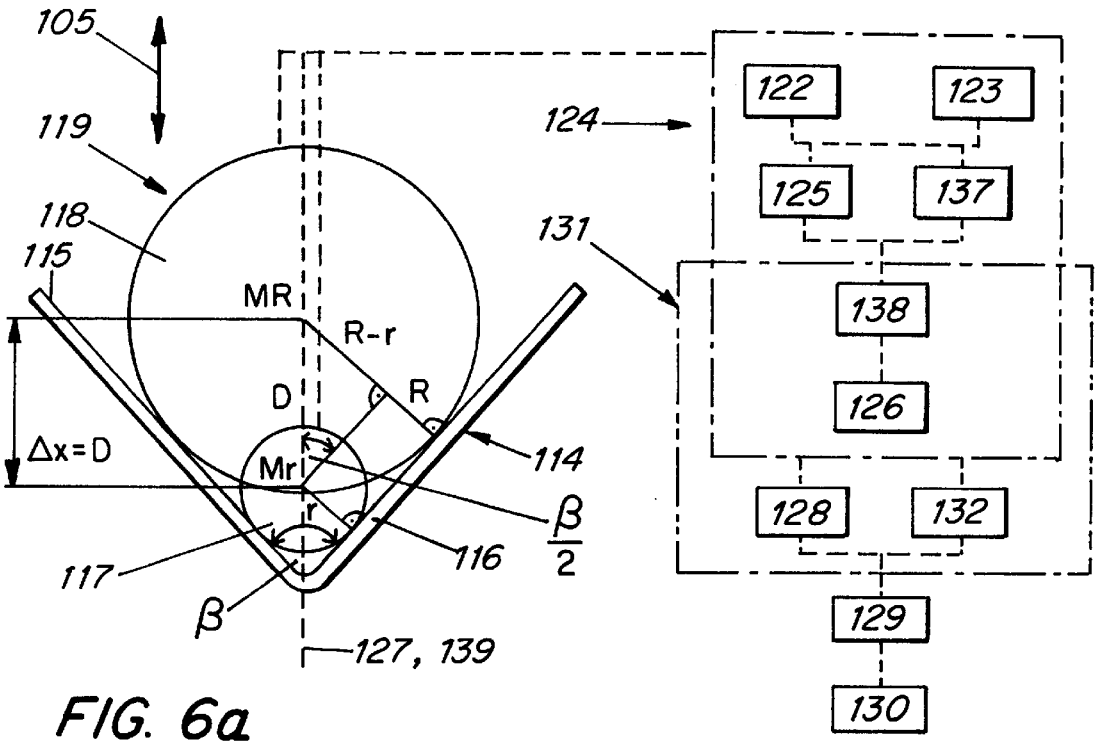
FIGS. 6*a* and 6*b* are diagrammatic illustrations of the functioning of the device for determining the change in the actual size of bending angle on the bending press in FIGS. 4 and 5, FIGS. 7*a* and 7*b* are partially diagrammatic views of a third embodiment of measuring a bending device for determining the change in the actual size of the bending angle.
Figure 6B:
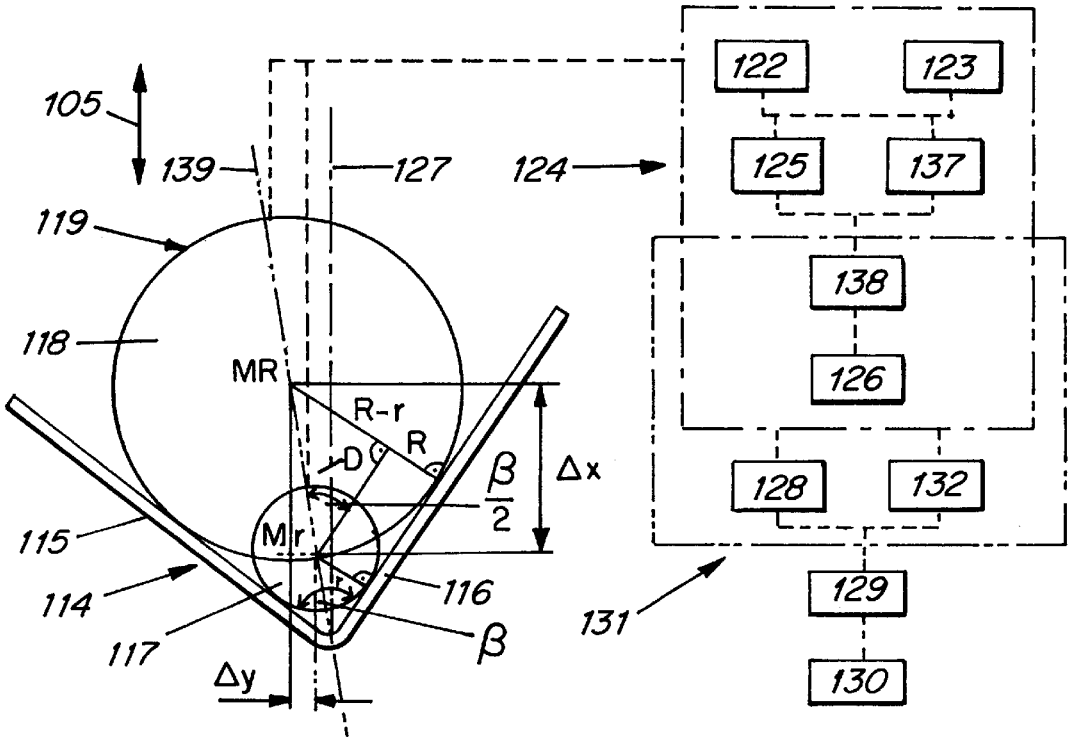

The design and function of a device provided on the sinking bending press 101 to determine the change in the actual size of a bending angle β can be seen in FIGS. 6*a* and 6*b*.

Components of the device 119 for determining the change in the actual size of the bending angle β are, for one thing, the scanning elements 117, 118 already described in FIGS. 4 and 5, and, for another, a device connected to the latter for determining the actual size of the bending angle β. The latter is in turn composed of the slides 122, 123 shown individually in FIGS. 4 and 5 and only hinted at for the sake of simplifying the drawing in FIGS. 6*a* and 6*b*, a device 125 for determining the relative position of the slides 122, 123 and the scanning elements 117, 118 in the bending direction 105, a device 137 for determining the relative transverse deflection of the scanning elements 117, 118 transverse to the plane defined by the forming edge 109 of the upper die 108 and the bending direction 105, an evaluation device 138 for considering any relative transverse deflection of the scanning elements 117, 118 transverse to said plane and a computer 126 for calculating the actual size of the bending angle β. The device 124 for determining the actual size of the bending angle β is connected to a comparison unit 128 for determining any deviations between the actual sizes of the bending angle β determined one after the other and a device for comparing the actual size of the bending angle β with the desired size. The comparison unit 128 finally is coupled to a drive control 129 and that in turn is coupled to a machine drive 130 on the sinking bending press 101. The functions of the evaluation device 138, the computer 126 and the comparison unit 128 are performed by a central computer 131.

To determine the change in the actual size of the bending angle β, two cases must be differentiated. In one, as shown in FIG. 6*a*, the axis of movement 127 of the scanning elements 117, 118 in the bending direction 105 can coincide with a median 139 of the bending angle β. In another, the course of the axis of movement 127 can deviate from the course of the median 139. The latter case is illustrated in FIG. 6*b*.

Based on the symmetrical design of the scanning elements 117, 118, designed as circular disks, with regard to the median 139 of the bending angle β, the center MR of scanning element 118 and the center Mr of scanning element 117 for scanning elements 117, 118 in the measurement position are always on the median line 139. Scanning element 118 has a radius R, scanning element 117 a radius r. The sides 115, 116 of the workpiece of the bent sheet metal 114 run tangentially to the scanning elements 117, 118.

With the device 125 for determining the relative position of the scanning elements 117, 118 in the bending direction 105, independent of the mutual course of the axis 127 of movement—the bending direction 105 and the median 139—always in the bending direction 105, i.e., the distance in the direction of the axis of movement 127 of centers Mr and MR of scanning elements 117, 118 is found. That distance is marked Δx in FIGS. 6*a* and 6*b*. For the distance between the centers Mr and MR of the scanning elements 117, 118 in the direction of the median 139, the same symbol D was chosen in FIGS. 6*a* and 6*b*.

Based on the known mathematical relations, it is true that:

$$\sin\frac{\beta}{2} = \frac{R-r}{D}$$

$$\Leftrightarrow \beta = 2 \arcsin\frac{R-r}{D}$$

Since the radii r and R of the scanning elements 117, 118 are known, their difference (R−r) can definitely be calculated. The size D is identical to the size Δx in the case in FIG. 6*a*. The size Δx is measured by means of the device 125. The actual size of the bending angle β is found accordingly when the axis 127 of movement of scanning elements 117, 118 or the bending direction 105 coincide with the median 139 as follows:

$$\beta = 2 \arcsin\frac{R-r}{\Delta x}$$

If the course of the axis of movement 127 or the bending direction 105 deviates from the course of the median 139, as sketched in FIG. 6*b*, then in calculating the actual size of the bending angle β, a relative transverse deflection Δy of the scanning elements 117, 118 transverse to the plane defined by the forming edge 109 of the upper die 108 and the bending direction 105 must be considered. The size Δy is measured by means of the device 137 for determining the relative transverse deflection of scanning elements 117, 118. The following then applies:

$$D^2=(\Delta x)^2+(\Delta y)^2$$

The bending angle β in the case of a deviation in the course of the axis of movement 127 or the bending direction 105 and the median 139 in FIG. 6*b* is then found as follows:

$$\beta=2 \arcsin R-r$$

$$[\text{square root of}]\ (\Delta x)^2+(\Delta y)^2$$

In the case in FIG. 6*b*, again, the variable Δx is found by means of the device 125 for determining the relative position of the scanning elements 117, 118 in the bending direction 105 or in the direction of the axis of movement 127. The evaluation device 138 takes into account that, besides a relative position Δx, a relative transverse deflection Δy must go into the calculation of the bending angle β. Finally, the computer 126 supplies the actual size of the bending angle β as in FIG. 6*a*.

Two actual sizes of the bending angle β continuously determined one after the other are checked for any deviation by the comparison unit 128. If the deviation is 0 or a value close to 0, this indicates that the bent sheet metal 114 has reached its load-free or its quasi-load-free state during its release from the upper die 108 and the bending angle β is its actual size in the preceding bending cycle. If this is found, a signal is transmitted to the drive controls 129 to stop the machine drive 130. The actual size of the bending angle β that exists when the load-free or quasi-load-free state of the bent sheet metal 114 occurs is compared with the predetermined desired size of the bending angle β in the comparison device 132. If the actual size of the bending angle β made in the preceding bending cycle is over the desired size, then the central computer 131 will set parameters for a subsequent corrective bending cycle as described above with FIGS. 1 to 3, and rebending will be started and carried out by the drive controls 129 and the machine drive 130 they run.

FIGS. 7*a* to 10 concern a bending press 201 with a device 219 for determining the change in the actual size of the bending angle β, which was made on the sheet metal 214 by the action of a upper die 208 and a lower die 210 with workpiece sides 215, 216. The device 219 for determining the change in the actual size of the bending angle β has scanning elements 217, 218, which can be moved along an axis of movement 227 in a bending direction 205 relative to the upper die 208 with a forming edge 209 and relative to one another. The scanning elements 217, 218 can also be deflected in relation to one another crosswise to the plane defined by the forming edge 209 of the upper die 208 and the bending direction 205. Unlike scanning elements 117, 118 in FIGS. 4 to 6*b*, scanning elements 217, 218 do not take the form of circular disks, but segments of circular disks. Scanning elements 217, 218 are designed as small thin plates identical to scanning elements 117, 118. The width of a common guide slot 233 for scanning elements 217, 218 on the upper die 208 can therefore be kept small in the direction of the forming edge 209.

The actual size of the bending angle β is determined by means of a device 224. Device 224 for determining the actual size of the bending angle β is part of device 219 for determining the change in the actual size of the bending angle β and has two slides 222, 223 holding scanning elements 217, 218, a device 225 for determining the relative position of slides 222, 223 or scanning elements 217, 218 in the bending direction 205, a device 237 for determining the relative transverse deflection of scanning elements 217, 218 transverse to the plane defined by bending direction 205 and the axis of movement 227 and the forming edge 209, an evaluation device 238 for considering any transverse deflection of the scanning elements 217, 218 crosswise to the plane specified and a computer 226 for calculating the actual size of the bending angle β. Coupled to it is device 224 with comparison unit 228, by means of which, if necessary, the difference between two actual sizes of the bending angle β found one after the other is calculated and which is also one component of device 219 for determining the change in the actual size of the bending angle β. The comparison unit 228 is in turn connected to the controls 229 for a machine drive 230. In a comparison device 232, the actual size of the bending angle β determined by the device 224 when the load-free or quasi-load free state of the sheet metal 214 occurs is compared with a predetermined desired value for the bending angle β. The evaluation device 238, the computer 226, the comparison unit 228 and the comparison device 232 are all in a central computer 231.

The bending press shown in FIGS. 7*a* to 10 works like the embodiment in FIGS. 4 to 6*b*. Accordingly, on a bending press as shown in FIGS. 7*a* to 10, when determining the change in the actual size of the bending angle β, it is considered whether, and, if necessary to what extent, the course of a median 239 of the bending angle β deviates from the course of the bending direction 205 or the axis of movement 227 of scanning elements 217, 218 which are symmetrical in relation to the median 239.

Figure 7A:
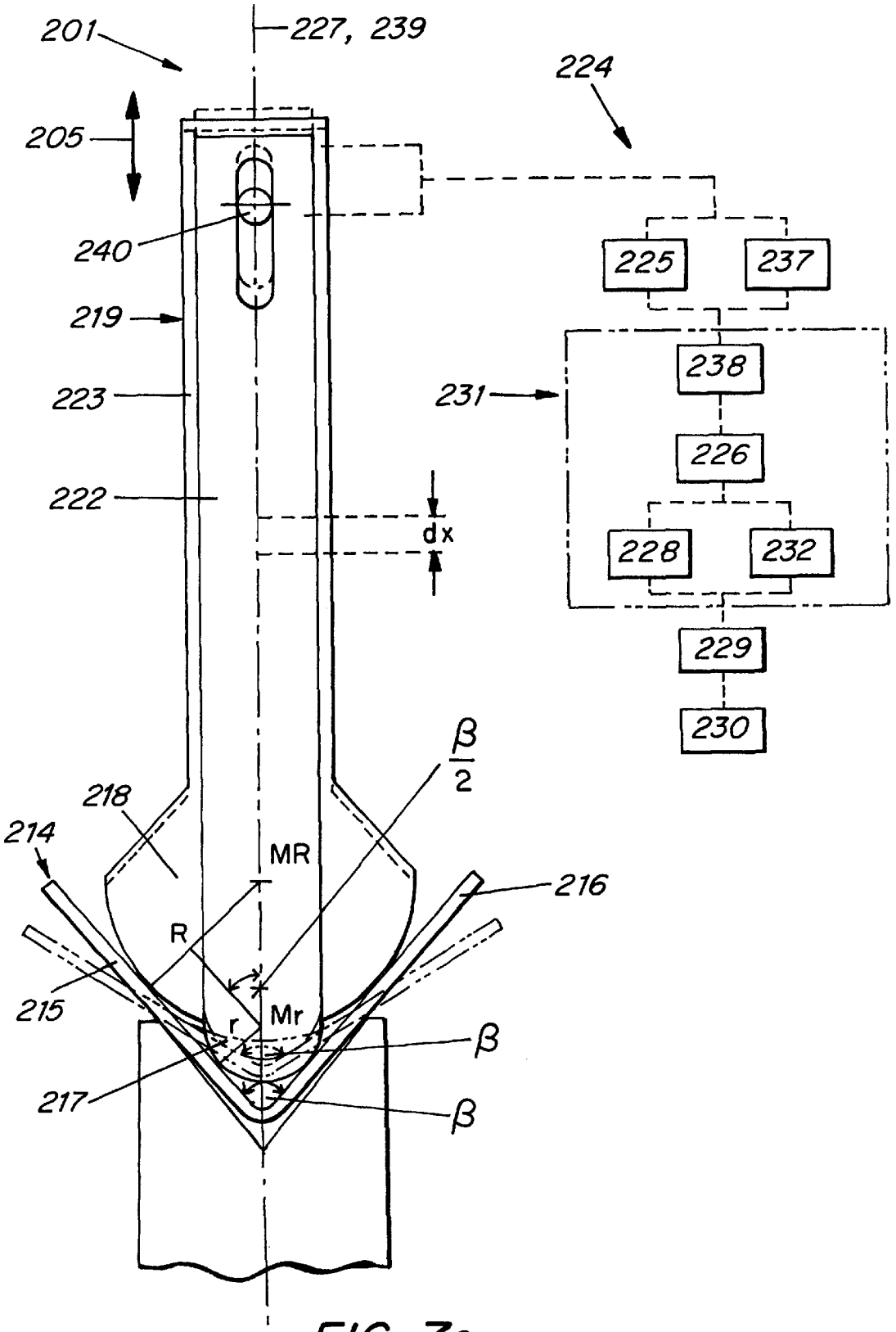

FIG. 7*a* illustrates the usual case, in which the median 239 of the bending angle β on the bent sheet metal 214 coincides with the axis of movement 227 of scanning elements 217, 218 and thus with the bending direction 205. The solid lines show the ratios for a upper die 208 in the lower end position for the work cycle in question. The broken lines show the bent sheet metal 214 and the scanning elements 217, 218 in the state where the sheet metal 214 is released from the upper die 208.

When the sheet metal 214 is released from the upper die 208 after the bending process, the actual size of the bending angle β formed by the sides 215, 216 of the sheet increases. Associated with this is a change in the relative position of scanning elements 217, 218 as already described above. When their relative position changes, the scanning elements 217, 218 run on a guide pin 240, which is mounted so it is stationary on the upper die 208 and goes into longitudinal holes 241, 242 on the slides 222, 223 that overlap one another.

If the axis of movement 227 of scanning elements 217, 218 in the bending direction 205 and the median 239 of the bending angle β are equal in coverage, the determination of the actual size of the bending angle β made when the sheet metal 214 is released is similar to the process described above in FIG. 6*a* based on the distances measured from the centers Mr and MR of the scanning elements 217, 218 in the bending direction 205 and the difference between the known radii r and R of scanning elements 217, 218. In each measurement, the change in distance dx of the centers Mr and MR that occurred compared to the preceding measurement is determined. By adding the changes in the distances, the distance of the centers Mr and MR of the scanning elements is given, starting from an initial distance value.

Figure 7B:
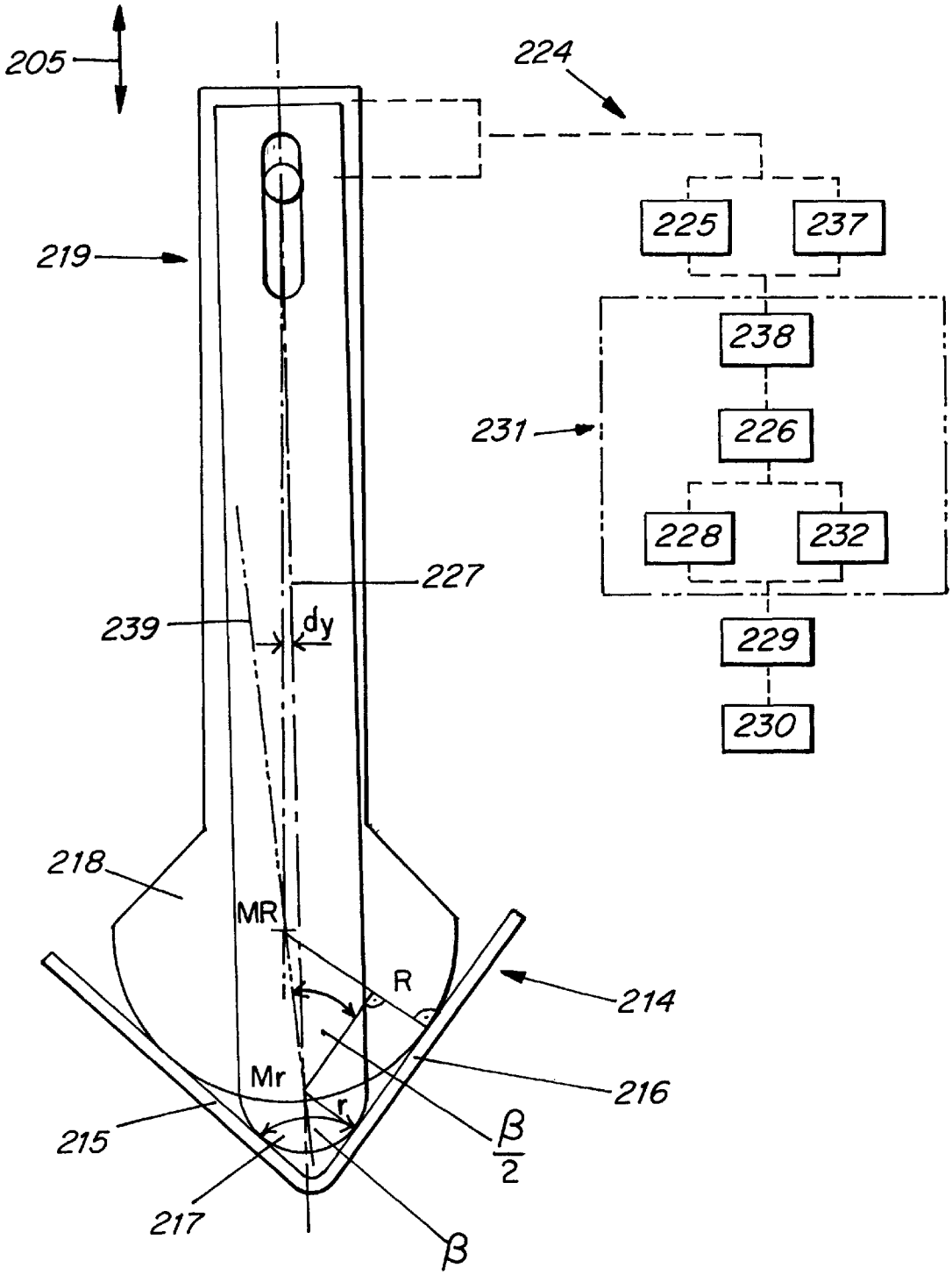

If the course of the axis of movement 227 of scanning elements 217, 218 and the bending direction 205 and the median 239 of the bending angle β deviate from one another, as shown in FIG. 7*b*, then in determining the actual sizes of the bending angle β made when the sheet metal 214 is released from the upper die 208 one after the other, plus the value dx, a value dy is considered, which represents the change in the relative transverse deflection of scanning elements 217, 218 transverse to the plane defined by the forming edge 209 and the bending direction 205. It considers that the value of dy in FIG. 6*b* is not identical to the amount of the change in the relative transverse deflection of the centers MR and Mr of scanning elements 217, 218, but that there is a geometric connection between the value dy and the amount of change in the relative transverse deflection in the centers MR and Mr, which can be described, for example, by a set of beams. Starting from an initial value for the relative transverse deflection of the centers MR and Mr, by adding the changes dy found, the relative transverse deflection of the centers MR and Mr assigned to the respective measuring time is found. How the actual sizes of the bending angle β are found from the relative transverse deflection and from the distances calculated as described for the centers Mr and MR in the bending direction 205 has already been described in detail in FIG. 6*b* above. The relative transverse deflection and the distance of the centers Mr and MR in the bending direction 205 is calculated, like the determination of the actual sizes of the bending angle β, by means of the central computer 231 or its computing unit 226 and/or its evaluation device 238.

In the case of the bending press 201 in FIGS. 7*a* to 10, the relative movement between the upper die 208 and the lower die 210 also ends as soon as the load-free or quasi-load-free state of the sheet metal 214 occurs. The actual value of the bending angle β at that point is compared to the desired size. Any deviation found is used as the basis for setting the parameters for a subsequent corrective bending cycle, which is automatically started and carried out by the central computer 231, including the drive control 229. The tooling of the workpiece described, including checking the results, is repeated automatically until the actual size of the bending angle β is identical to the preset desired size.

Figure 8:
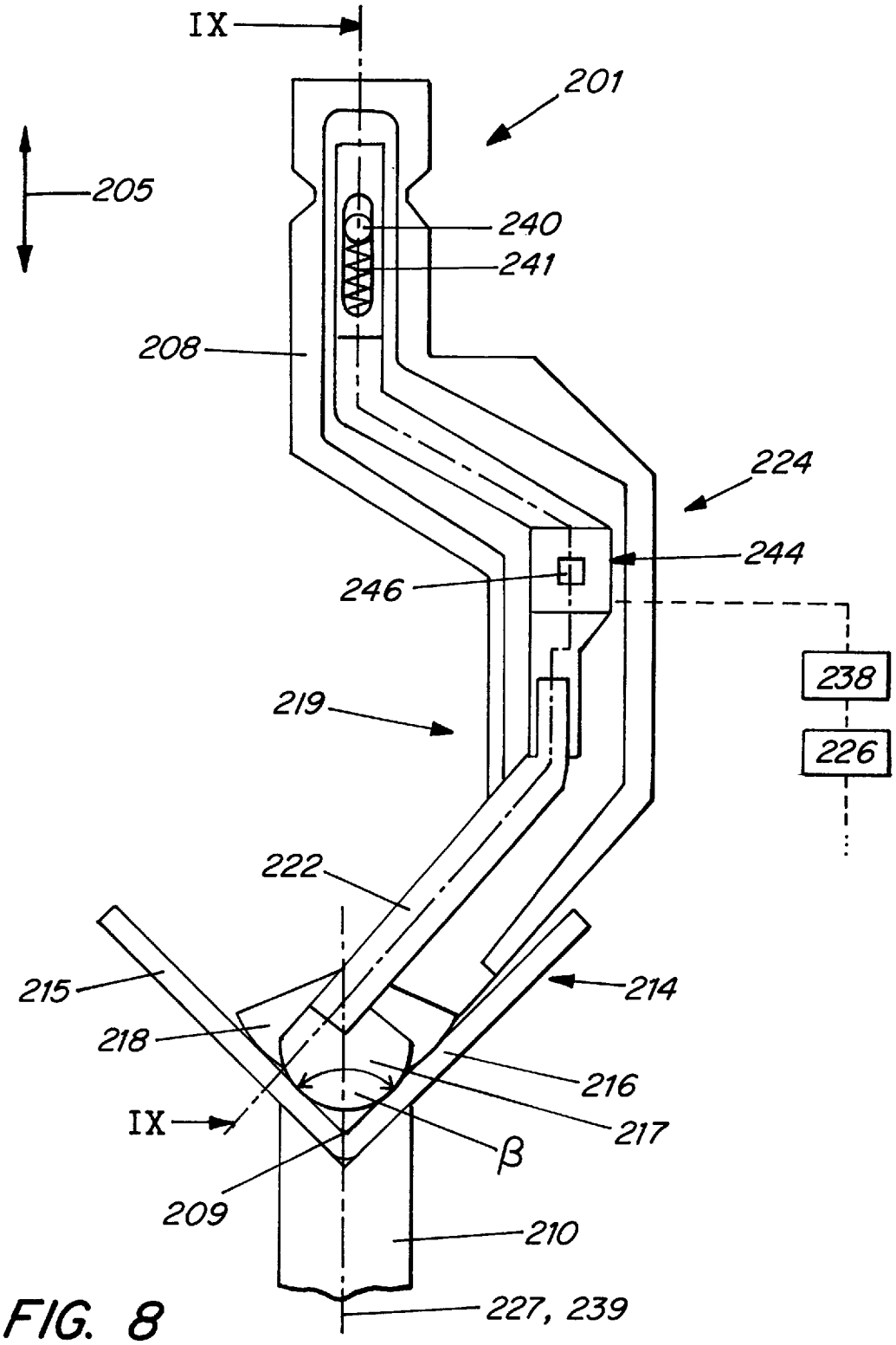
FIG. 8 is a sectional view of a bending press with a measuring device similar to that of FIGS. 6 and 7 according to FIGS. 7*a* and 7*b,*
Figure 9:
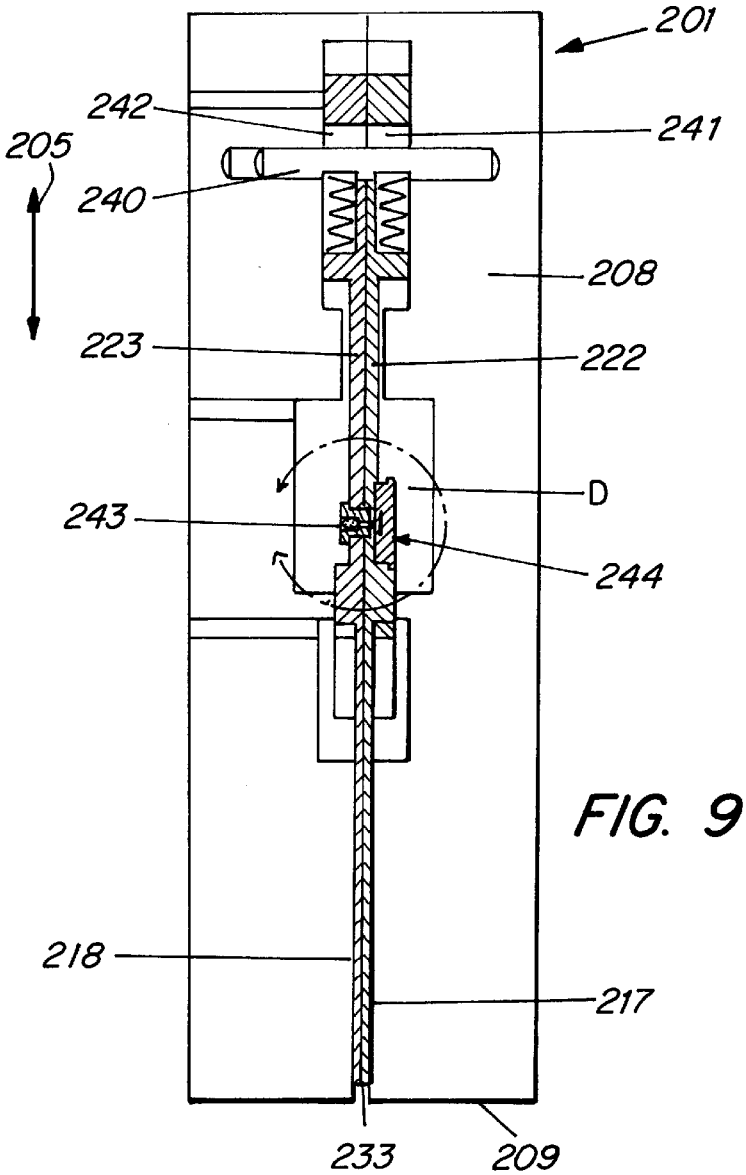
FIG. 9 is a sectional view of the upper die in a top view of the cutting surface running perpendicular to the drawing plane along the line IX—IX in FIG. 8.
Figure 10:
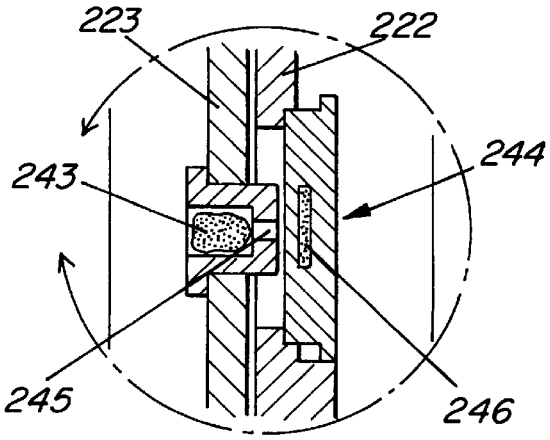
FIG. 10 is an enlarged presentation of the area D in FIG. 9.

How the devices 225, 237 shown only in outline in FIGS. 7*a* and 7*b* for determining the relative position of the scanning elements 217, 218 in the bending direction 205 or for determining the relative transverse deflection of the scanning elements 217, 218 are actually constituted can be inferred from FIGS. 8 to 10, as can the technically specific design of the other components shown in general layout in FIGS. 7*a* and 7*b*.

As shown in FIGS. 8 to 10, the upper die 208 is designed with multiple angles and holds the correspondingly designed slides 222, 223 inside it. They are connected on their lower end rigidly to the scanning elements 217, 218 designed as segments of circular disks. The upper die 208 is used for bending U-shaped bending parts.

Based on the form of the guide for slides 222, 223 on the guide pin 240 described, slides 222, 223, along with the scanning elements 217, 218 placed on them, can execute, besides a translating relative movement in the bending direction 205, a pivoting movement transverse to it.

The device 225 for determining the relative movement of slides 222, 223 and scanning elements 217, 218 in bending direction 205 has a light source in the form of an LED 243 on the slide 223 and an optical sensor assigned to the LED 243 in the form of a PSD (Position Sensitive Detector) 244 on slide 222. The light from LED 243 falls through an aperture 245 onto an active surface 246 of the PSD. The light hitting the active surface 246 of the PSD 244 generates a photocurrent, by means of which the above-mentioned relative position change dx of slides 222, 223 and by means of the relative position change, the relative position of slides 222, 223 and hence scanning elements 217, 218 can be determined in the bending direction 205. LED 243 and PSD 244 also simultaneously function as integral parts of device 237 for determining the relative transverse deflection of scanning elements 217, 218 transverse to the plane defined by the forming edge 209 and the bending direction 205. They are used to find the change dy in the relative transverse deflection of scanning elements 217, 218.

Figure 11:
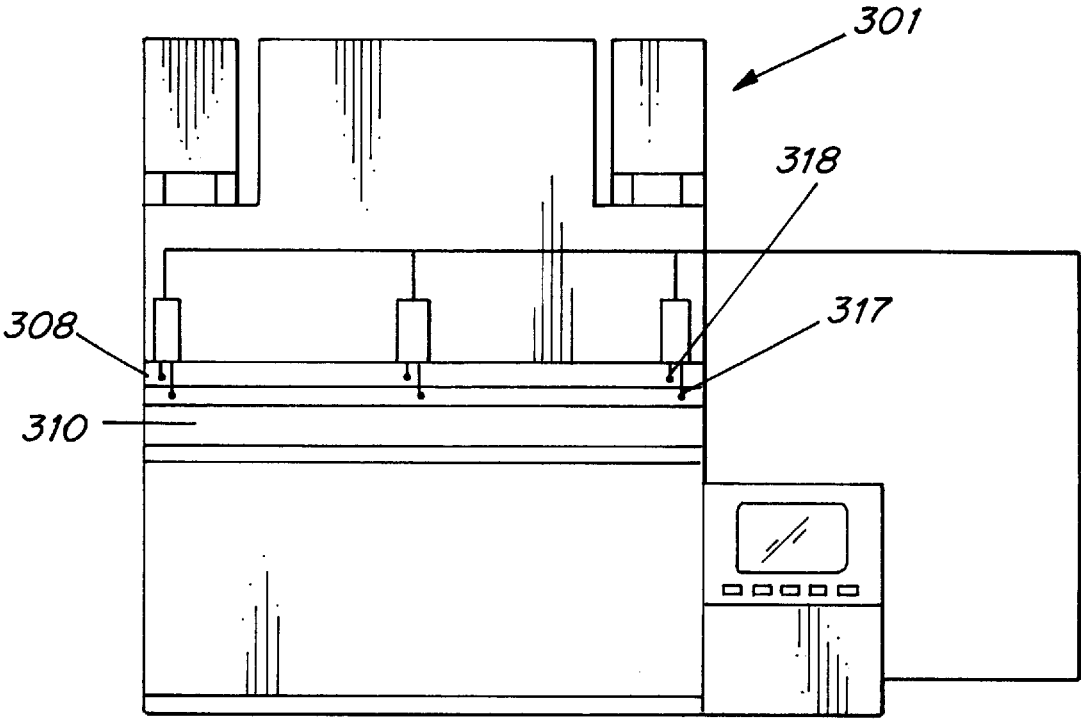
FIG. 11 shows a fourth form of embodiment of a measuring device for determining the change in the actual size of the bending angle in top view.

Lastly, FIG. 11 shows a bending press, which has, on a upper die 308 above a lower die 310, three pairs of scanning elements 317, 318 in all distributed in the longitudinal direction of the upper die, by means of which bending angle measurements can be taken at three points on the upper die To determine the change in the actual size of a bending angle made and to control the bending press 301, devices are used as described in FIGS. 1 to 10 above. For example, scanning elements are used that are designed differently in pairs.

We claim:

1. In a method for bending workpieces to a desired bend angle between a pair of dies, the steps comprising:

(a) placing a workpiece between a lower die having a generally V-shaped recess therein and an upper die having a cooperating V-shaped lower end to form a desired bend angle in said workpiece;

(b) moving said upper die towards said lower die to bend said workpiece into a V-shaped configuration in said recess of said lower die;

(c) moving said upper die away from said lower die to remove the deforming force on said workpiece;

(d) continuously measuring the included angle of said V-shaped configuration of said workpiece upon removal of said deforming force until substantially no further change in included angle is determined to provide the resultant measured included angle, said measuring step sensing the position of said workpiece at two vertically spaced positions on each side of said upper die;

(e) comparing the resultant measured included angle of said workpiece with the desired bend angle for said workpiece; and (f) if said resultant measured included angle is less than said desired bend angle, moving said upper die towards said lower die to bend said workpiece further, and repeating steps (d) and (e) and (f) until the resultant measured included angle corresponds to said desired bend angle.

2. The method of bending workpieces in accordance with claim 1 wherein the change in the measured included angle per unit length of movement of said upper die away from said lower die is recorded.

3. The method of bending workpieces in accordance with claim 1 wherein said movement of said upper die away from said lower die is terminated when the measured change in included angle decreases to a predetermined value.

4. The method of bending workpieces in accordance with claim 3 wherein said angle is measured continuously during the movement of said upper die towards said lower die and said movement towards said lower die is terminated when said measured included angle $\beta$ reaches a predetermined value ($\beta_0$) and, wherein after said movement of said upper die away from said lower die is terminated, the difference between the measured included angle and predetermined value $\beta_0$ ($\beta_1-\beta_0$) is used to calculate a new predetermined value $\beta_2$ for the next movement of said upper die towards said lower die.

5. In a bending press for sheet metal and the like, the combination comprising:

(a) a lower die having a generally V-shaped recess therein;

(b) an upper die having a cooperating V-shaped lower end to form a desired bend angle in a workpiece;

(c) drive means for moving said upper die towards said lower die to bend a workpiece into said recess of said lower die to produce a bend with an included angle;

(d) control means for said drive means;

(e) bend angle sensing means provided at two vertically spaced sensor points on each side of said upper die for measuring the included angle of the bent workpiece; and (f) means for comparing the measured included angle with a predetermined bend angle, said comparing means providing a control signal to said control means to terminate the movement of said upper die towards said lower die when said measured included angle equals said predetermined bend angle.

6. The bending press in accordance with claim 5 wherein said bend angle sensing means includes slides movable relative to said upper die in the direction of movement of said upper die.

7. The bending press in accordance with claim 5 wherein said bend angle sensing means includes a light source at one of said vertically spaced sensor points on each side of said upper die and an optical sensor at the other of said vertically spaced sensor points, said light source and said optical sensor being movable with said upper die.

8. The bending press in accordance with claim 7 wherein said light source is a light emitting diode (LED) and said sensor is a position sensitive detector (PSD).

9. The bending press in accordance with claim 5 wherein said angle sensing means comprising scanning elements projecting laterally of said upper die.

10. The bending press in accordance with claim 9 wherein said scanning elements are segments of discs.

11. The bending press in accordance with claim 9 wherein said scanning elements can be deflected towards the center-line of said upper die.

12. The bending press in accordance with claim 11 wherein said angle sensing device includes means for determining the amount of deflection.

13. The bending press in accordance with claim 12 wherein said deflection determining means includes a light source at one of said vertically spaced sensor points on each side of said upper die and an optical sensor at the other of said vertically spaced sensor points, said light source and said optical sensor being movable with said upper die.

14. The bending press in accordance with claim 13 wherein said light source is a light emitting diode (LED) and said sensor is a position sensitive detector (PSD).

* * * * *